United States Patent [19]

Stroi

[11] Patent Number: 4,634,140

[45] Date of Patent: Jan. 6, 1987

[54] PROCESS OF MANUFACTURING A SKI AND A SKI WHICH IS MANUFACTURED BY THAT PROCESS

[75] Inventor: Johann Stroi, Ried im Innkreis, Austria

[73] Assignee: Fischer Gesellschaft m.b.H., Ried im Innkreis, Austria

[21] Appl. No.: 665,379

[22] Filed: Oct. 26, 1984

[30] Foreign Application Priority Data

Oct. 27, 1983 [AT] Austria ..... 3820/83
Sep. 2, 1984 [AT] Austria ..... 416/84

[51] Int. Cl.[4] ..... B29C 45/00; B29C 47/00; B29D 9/00; A63C 5/00

[52] U.S. Cl. ..... 280/610; 264/510; 264/511; 264/516; 264/571; 264/101; 264/102; 264/128; 264/261; 264/DIG. 78; 425/DIG. 59; 425/DIG. 60

[58] Field of Search ..... 264/510, 511, 516, 571, 264/102, 101, 128, 261, DIG. 78; 280/610; 425/110, DIG. 59, DIG. 60

[56] References Cited

U.S. PATENT DOCUMENTS

| | | | |
|---|---|---|---|
| 3,026,575 | 3/1962 | Lusher et al. | 18/59 |
| 3,192,594 | 7/1965 | Fougea | 25/121 |
| 3,194,572 | 7/1965 | Fischer | 280/610 |
| 3,498,626 | 3/1970 | Sullivan | 280/11.3 |
| 3,502,531 | 3/1970 | Shockey | 264/510 X |
| 3,705,729 | 12/1972 | Arnsteiner | 280/610 |
| 3,816,573 | 6/1974 | Hashimoto et al. | 264/46.5 |
| 3,875,278 | 4/1975 | Brandt | 264/90 |
| 3,958,810 | 5/1976 | Böhm | 264/46.5 X |
| 3,975,479 | 8/1976 | McClean | 264/102 |
| 4,030,953 | 6/1977 | Rutschow et al. | 156/79 |
| 4,044,083 | 8/1977 | Howe et al. | 264/45.3 |
| 4,201,823 | 5/1980 | Russell | 428/246 |
| 4,205,031 | 5/1980 | Almqvist et al. | 264/510 X |
| 4,259,274 | 3/1981 | Tiitola | 264/46.5 |

FOREIGN PATENT DOCUMENTS

| | | | |
|---|---|---|---|
| 1145905 | 5/1983 | Canada . | |
| 2054952 | 5/1971 | Fed. Rep. of Germany . | |
| 2007054 | 9/1971 | Fed. Rep. of Germany | 264/510 |
| 2014025 | 10/1971 | Fed. Rep. of Germany . | |
| 2127330 | 12/1972 | Fed. Rep. of Germany . | |
| 2155146 | 5/1973 | Fed. Rep. of Germany . | |
| 2940851 | 4/1980 | Fed. Rep. of Germany . | |
| 895339 | 5/1962 | United Kingdom | 264/511 |

OTHER PUBLICATIONS

"Ski" Magazine Buyer's Guide 1985, p. 46.
"Skiing" Magazine, vol. 38, No. 3, Nov. 1985, pp. 234 and 142.

*Primary Examiner*—Nancy A. B. Swisher
*Attorney, Agent, or Firm*—Fleit, Jacobson, Cohn & Price

[57] ABSTRACT

A process of manufacturing a ski, particularly a laminated ski, which is composed of a plurality of components, and a ski manufactured by that process. In the process, the components of the ski are placed into a mold, which is adapted to be evacuated, and the mold is subsequently evacuated. A liquid binder, such as a liquid resin, is supplied to the mold during or after its evacuation. Air is sucked from the mold at one end of the longitudinal extent of the ski. The liquid binder is supplied to the mold at the other end of the longitudinal extent of the ski. In the finished ski a strip of solidified binder extends in at least one vertical or horizontal longitudinal plane of the ski, preferably in a central longitudinal plane of the ski, over at least part of the length and preferably over at least one half of the length of the ski.

10 Claims, 4 Drawing Figures

PROCESS OF MANUFACTURING A SKI AND A SKI WHICH IS MANUFACTURED BY THAT PROCESS

SUMMARY OF THE INVENTION

A process and apparatus for manufacturing a ski. In the process, the components are placed into a mold, which is adapted to be evacuated. The mold is then evacuated and is supplied with a liquid binder during or after the evacuation. Air is sucked from the mold at one end of the ski and the binder is supplied to the mold at the other end of the longitudinal extent of the ski. In the finished ski, the binder constitutes a strip extending in at least one vertical or horizontal longitudinal plane of the ski.

BACKGROUND OF THE INVENTION

This invention relates to a process of manufacturing a ski, which is composed of a plurality of components, particularly a laminated ski, with the aid of a vacuum.

Another subject matter of the invention is a ski manufactured by that process.

U.S. Pat. No. 4,259,274 discloses the use of a vacuum in the manufacture of skis. The vacuum serves only to hold the top and bottom plastic layers against the top and bottom walls of the mold before the latter is filled with foam formed in situ.

Laid-open German Application No. 2,155,146 discloses a process in which the vacuum is used only to make the core of the ski in that air is sucked from the mold between a plastic sheet and the walls of the mold so that that plastic sheet forces the reinforcement under pressure against the glass fiber mat. During the application of that pressure the polyester resin is cured and firmly joins the glass fiber mat and the reinforcement to form a carrying core sheath. During that operation the side walls of the mold cavity are lined with mock-up elements instead of the subsequently provided top and bottom coverings.

It is an object of the invention to provide a manufacturing process which permits a particularly economical manufacture of a ski which has good skiing properties and in which the components of the ski are so joined that they are firmly held together and the skiing properties will not be adversely affected.

In a process of the kind described first hereinbefore this object is accomplished in accordance with the invention in that the components of the ski are placed into a mold which is adapted to be evacuated, the mold is subsequently evacuated, and a binder, such as liquid resin, is supplied to the mold during or after its evacuation, wherein air is sucked from one end of the longitudinal extent of the ski and the liquid binder is supplied to the mold at the other end of the longitudinal extent of the ski.

In the ski manufactured by that process a strip of binder extends in at least one vertical or horizontal longitudinal plane of the ski, preferably in a central longitudinal plane of the ski.

BRIEF DESCRIPTION OF THE DRAWINGS

Further details of the invention will be explained in more detail with reference to the drawing, in which.

DESCRIPTION OF THE PREFERRED EMBODIMENTS

Figure 1:
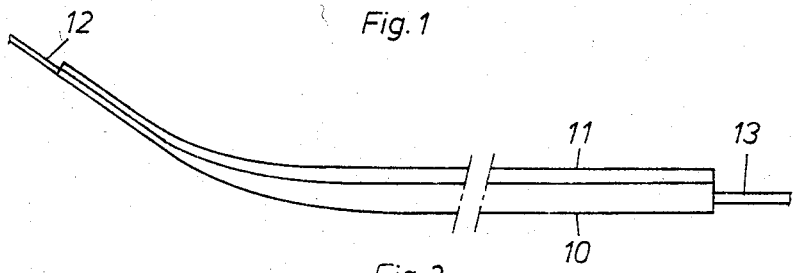
FIG. 1 is a side elevation showing a mold for directly receiving the components of the ski.
Figure 2:
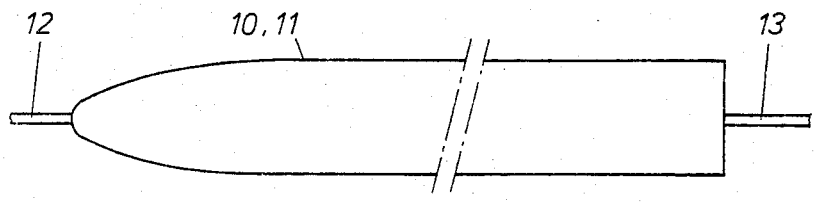
FIG. 2 is a top plan view showing that mold.

As an illustrative embodiment the manufacture of a sandwich-type laminated ski will be described. Such ski may include a core 1, upper and lower covering layers 2 and 2', which cover the core and may consist of any desired material, such as metal, wood, plastics or glass fibers, top and bottom edges 3, 3A and 3', 3A', respectively, which are L-shaped in cross-section, a bottom surface layer 4, and a top layer 5. The core 1 is laterally covered by strips 7 consisting, e.g., of plastic.

Two intermediate layers 8 and 9 are respectively provided between the covering layer 2 and the top layer 5 and between the covering layer 2' and the bottom layer 4. Said intermediate layers 8 and 9 occupy the spaces between the horizontal flanges of the edges 3, 3A and 3', 3A', respectively.

Figure 3:
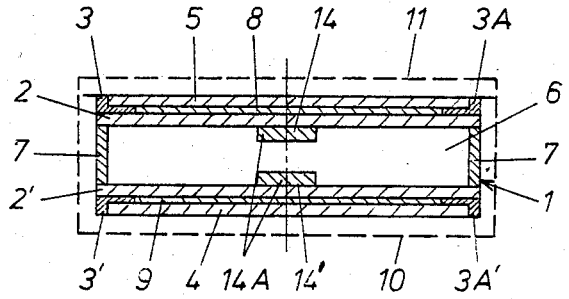
FIG. 3 is a transverse sectional view showing a ski manufactured by the process in accordance with the invention and FIG. 4 is a similar transverse sectional view showing another embodiment of the ski manufactured by the process in accordance with the invention.

The core 1 may be of any desired shape. As shown in FIG. 3 it may consist, e.g. of a shaped body 6 made of glass-fiber-reinforced plastic, which body is formed with at least one passage 14, which preferably extends in the longitudinal direction. In the present case two passages 14 and 14' are provided, which extend along the top and bottom sides of the core at the center of the width thereof and which may extend only over part of the length or throughout the length of the ski. A plurality of passages of the kind described may be provided in each of the top and bottom surfaces of the core.

Figure 4:
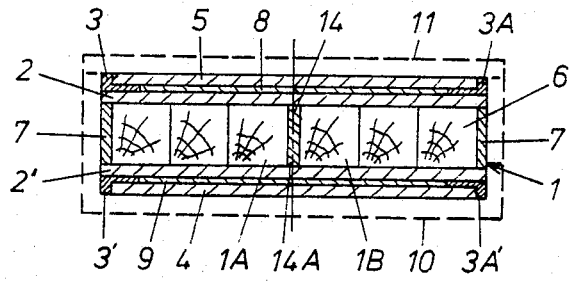

For the process in accordance with the invention the components of the ski are inserted into the tubelike mold 10, indicated by dotted lines in FIG. 3 and 4, in such a manner that said components constitute the body of the ski. An airtightly sealing cover 11 is then placed onto the mold, possibly with a seal interposed. The mold is connected at its tip end to a suction line 12 and at its tail end to a line 13 for supplying a binder, such as a liquid resin. When air is sucked from the tip, a vacuum will be established in all joints between the components of the ski so that binder will be sucked through the line 13 and will fill all joints in the ski. Alternatively, the binder may be supplied only after a preliminary evacuation or when the evacuation has been completed. Finally, the binder may also be supplied under additional pressure.

The binder enters the passages 14, 14' and is evenly distributed throughout the body of the ski or the joints thereof. A narrow strip 14A of solidified binder is thus formed in the passages 14, 14'. A distributing chamber may be provided in the region in which the binder enters the ski. A resin permeable material can be disposed in at least part of the passage or passages which contain the strip or strips of the solidified binder. Additionally, fibers can be provided in the solidified binder that constitutes the strips.

It will be understood that changes in design and in process technology may be adopted within the scope of the invention. The passage 14 may be provided at any desired location of the surface or of the interior of the core. For instance, the passage may be formed in the core or may extend partly or entirely in one or more layers which adjoin the core. In the latter case the passage may at least adjoin the core. Moreover, the passage may extend over part of the height or throughout the height of the ski. The remarks made with respect to one passage are obviously applicable to a plurality of passages. Besides, a plurality of supply lines 13, which may be evenly spaced apart, may be distributed over the width of the ski along the tail thereof. The positions of the supply line or lines for resin and the suction line 12 may be interchanged.

In the drawing the line 13 is shown only at the heel end of the ski. But lines extending in the longitudinal direction of the ski may be provided also on the sides of the shovel.

In the embodiment of the core shown in FIG. 4, the core consists of juxtaposed, identical wooden bars 6, in the present case of six of such bars, and said bars are rectangular, particularly square, in cross-section. The passage 14 may extend throughout the height of the core or only over part of said height.

What I claim is:

1. A process of making a ski comprising the steps of:

a. placing the components of the ski comprising edge members, top and bottom members, intermediate layers and a core member which defines a longitudinal passage into a mold which is adapted to be evacuated and which includes a suction line at one longitudinal end to provide communication between the interior of the mold and a source of vacuum, and which includes a binder line at an opposite longitudinal end to provide communication between the interior of the mold and a source of liquid binder material, b. closing and airtightly sealing the mold, c. evacuating the air from the mold by applying a vacuum to the vacuum line, and d. supplying liquid binder material to said mold through the binder line, whereby the air is evacuated from the mold at one end of the longitudinal extent of the mold and whereby the liquid binder supplied to the mold at the other end of its longitudinal extent flows through the longitudinal passage of the core and fills the joints between the components of the ski to join said components so that they are firmly held together in a final ski structure.

2. A process according to claim 1, wherein said binder is supplied to said mold as the latter is evacuated.

3. A process according to claim 1, wherein said binder is supplied to said mold after it has been evacuated.

4. A ski made by a process comprising the steps of:

a. placing the components of the ski comprising edge members, top and bottom members, intermediate layers and a core member which defines a longitudinal passage into a mold which is adapted to be evacuated and which includes a suction line at one longitudinal end to provide communication between the interior of the mold and a source of vacuum, and which includes a binder line at an opposite longitudinal end to provide communication between the interior of the mold and a source of liquid binder material, b. closing and airtightly sealing the mold, c. evacuating the air from the mold by applying a vacuum to the vacuum line, and d. supplying liquid binder material to said mold through the binder line, whereby the air is evacuated from the mold at one end of the longitudinal extent of the mold and whereby the liquid binder supplied to the mold at the other end of its longitudinal extent flows through the longitudinal passage of the core and fills the joints between the components of the ski to join said components so that they are firmly held together in a final ski structure.

5. A ski according to claim 4 wherein said inner core member includes a narrow strip of solidified liquid binder that is received in said longitudinal passage and extends in at least one central longitudinal plane of the ski over at least one-half of the length of the ski.

6. A ski according to claim 4, wherein at least one strip of solidified binder extends in at least one layer over at least part of the width and over at least part of the height of the ski.

7. A ski according to claim 4, wherein resin-permeable material is disposed at least in part of the passage defining the strip or strips of the solidified binder.

8. A ski according to claim 4, wherein fibers are contained in the solidified binder which constitutes said strip or strips.

9. A ski according to claim 5, wherein the strip extends substantially over the height of the core of the ski.

10. A ski according to claim 4, wherein said ski includes a core having a plurality of longitudinally extending rectangular bars, and said strip of solidified binder is disposed between two said bars which are disposed on opposite sides of a central vertical longitudinal plane of the core member.

* * * * *